United States Patent [19]

Munderich

[11] 4,277,180

[45] Jul. 7, 1981

[54] METHOD AND APPARATUS FOR MAKING BITUMINOUS MIXTURES

[76] Inventor: Paul Munderich, Frankfurter Strasse 84, 6466 Gruendau-Rothenbergen, Fed. Rep. of Germany

[21] Appl. No.: 89,767

[22] Filed: Oct. 31, 1979

[30] Foreign Application Priority Data

Nov. 7, 1978 [DE] Fed. Rep. of Germany ..... 2848145

[51] Int. Cl.[3] ..... B28C 5/46

[52] U.S. Cl. ..... 366/7; 366/18; 366/23; 366/24; 366/25; 366/56; 366/63

[58] Field of Search ..... 366/2, 3, 4, 6, 7, 8, 366/18, 22, 23, 24, 25, 45, 56, 63, 144, 147, 148, 149, 185; 106/273 R, 277

[56] References Cited

U.S. PATENT DOCUMENTS

| | | | |
|---|---|---|---|
| 1,462,904 | 7/1923 | Finley | 366/4 |
| 1,703,999 | 3/1929. | Henley | 366/4 |
| 2,138,172 | 11/1938 | Johnson | 366/8 |
| 2,152,798 | 4/1939 | Fuller | 366/4 |
| 3,693,945 | 9/1972 | Brock | 366/2 |

FOREIGN PATENT DOCUMENTS

| | | |
|---|---|---|
| 1594815 | 12/1973 | Fed. Rep. of Germany . |
| 2102328 | 1/1976 | Fed. Rep. of Germany . |

OTHER PUBLICATIONS

"Strassenbau mit Shellbitumen", (Road Construction Using Shell Bitumen), 3rd Edition, 1954, by Deutsche Shell Aktiengesellschaft, published by Deutsche Shell Aktiengesellschaft, Hamburg, pp. 42 and 43.

*Primary Examiner*—Robert W. Jenkins
*Attorney, Agent, or Firm*—W. G. Fasse; D. F. Gould

[57] ABSTRACT

A bituminous mixture of aggregate and a bituminous binder, especially for road construction or repair is prepared by mixing a batch of still moist aggregate with the bituminous binder in a pressurized mixing container. The gauge pressure in the mixing container is maintained at or just above the saturation pressure of the water adhering to the surfaces of the aggregate, at the desired mixing temperature. Upon completion of the mixing the pressure in the mixing container is reduced to below one bar whereby moisture is removed from the mixture. The present mixing apparatus is rotatable about a hollow axle through which a supply of heating gas is maintained during the mixing. During the removal of the mixture from the mixing container the heating gas may be circulated through the next batch of aggregate being prepared.

20 Claims, 3 Drawing Figures

B
A
37
34
33
33
32
32
30
29
31
28
36
27
35
18
23
23
7
2
1
10
7
21
21
20
20
5
4
6
7
22
19
3
19
22
6
7
10
6
7

METHOD AND APPARATUS FOR MAKING BITUMINOUS MIXTURES

BACKGROUND OF THE INVENTION

The invention relates to a method and apparatus for making bituminous mixtures. More specifically, the invention relates to compounding a bituminous mixture of substantially moist aggregates and a hot bituminous binder, in which the aggregates and the bituminous binder are brought together at a predetermined mixing temperature in a mixing tank provided with mixing tools and are mixed to form a bituminous construction material, in particular for bituminous road construction. The aggregates used may range in their grain sizes from a powdery consistency to granular solids of mineral origin. A possible bituminous binder may be a thermoplastic binder based on petroleum or coal.

Processes for the compounding of bituminous mixtures have been disclosed in practice, and may essentially be divided into the following two groups. First, there are processes in which the solids are dried and heated before the bituminous binder, also heated and thereby liquified, is added, whereby the temperature of the solids is within the range of 130°-160° C.

As an example of these processes, there may be mentioned the known methods for the production of hot asphalt for road construction using bitumen as the binder. In this context, reference is made to "Strassenbau mit Shellbitumen" ("Road Construction Using Shell Bitumen"), 3rd Edition, 1954, by Deutsche Shell Aktiengesellschaft and published by Deutsche Shell Aktiengesellschaft, Hamburg, pages 42 and 43. According to the compounding schedule described in this publication the sands and crushed rocks are metered together into the drum dryer and, after drying and heating, are introduced at intervals, with the filler, into a weighing scale which empties into the mixer. The bituminous binder is introduced into the mixer, either at the same time as the other material or after the other material has been added.

This process has the disadvantage that the solids, which during drying must be heated to temperatures beyond the processing temperature of the particular binder, are exposed to abrasion as they are being dried, to a larger or lesser extent, whereby the heating gases become charged with very fine substances which must subsequently be precipitated again by means of expensive dust removing equipment. Besides, the energy consumption of this method is excessive.

Second, there are processes in which the solids, which are not yet dried, are combined with the liquified bituminous binder and the components are then mixed, while intensively heating the components that are being mixed. Such a process is disclosed in German Pat. No. 1,594,815. In using said known process, the binder is fed to the mineral solids, which are not yet dried and usually have a moisture content of 3 to 5% of $H_2O$, in a mixer, preferably through atomizing units, in such a manner that there is sufficient random distribution of this binder on the surfaces of the mineral substances.

When the addition has ended and the desired state of mixing is achieved, the mixture is fed, in the case of a batch type operation into a compensating tank and a discharge device. In a continuous operation the mixture is supplied into a dryer, preferably a drum dryer, and whereby the mixing continues in this dryer, while simultaneously heat is supplied intensively to provide the prescribed mixing temperature appropriate for the particular mixture or rather binder.

These mixing plants, which provide a reversal of the sequence of the individual process steps, which may be called the "classical" sequence, with reference to the bituminous compounding first described above, are still employed even today to the satisfaction of the operators, even though the originally expected freedom from dust cannot be called complete, since the point in time at which the binding of the very fine dust to the coarser grain by water ceases is not always exactly the same as that at which subsequent binding by the bituminous binder takes place. Uninterrupted binding of the dust to the coarser particles, regardless whether by water or binder, is, however, a prerequisite if the bituminous mixture compounding is to be free of dust to the maximum extent.

A particularly economical use of this process in the case of a continuous mixing operation was achieved, while accepting a relatively low expenditure for the dust removal in some cases, by the further development of the equipment necessary for executing the process. This development particularly involved omitting a separate mixer and performing the process in a single drum type combined mixing, drying and heating device as is described in particular in German Pat. No. 2,102,328.

Such an operating procedure which provides for a continuous metering of the binder as a function of the result of a continuous weight determination of the mineral substances is, however, not always usable or even permitted in certain countries of central Europe, in spite of the possibility, which exists today, of taking into account the moisture content of the solids by an automatic correction of the control value. This is so because a continuous weighing and measuring cannot give the almost exact accuracy of batchwise dosing. Furthermore, due to the continuous weighing and measuring it is difficult to adapt continuously operating plants to changed recipes, which is frequently necessary in the case of relatively small construction contracts or in the case of stationary plants. Besides, such changes in a continuously operating plant require a prolonged adaptation phase.

Summarizing, it may be said to these prior art developments that they indeed at least reduce the expenditure for the dust removing equipment. On the average, this reduction of expenditures corresponds, in the energy balance sheet, to one KW per ton of mixture produced. However, the visible emission of so-called blue vapors, caused by the direct contact of the burner gases with the binder and comprising a proportion of low-boiling hydrocarbons, from the bitumen, which can scarcely be detected analytically, again reduces the value of this development since maintaining a good appearance is essential. Such appearance requires the removal of the blue smoke at substantial costs.

It is also taken into consideration, in this context, that up to 40% of the present investment costs for a stationary compounding or mixing plant must be used to satisfy environmental protection conditions. Thus, the prior art has not yet been leading in the direction of a satisfactory solution.

In addition to these significant conditions to which prior art road construction is subject, one must take into account the increases is heating oil costs caused by the energy crisis which has meanwhile occurred, and which has caused approximately similar cost increases for the bituminous binder.

In this connection, it is appropriate to define the energy requirement necessary for the classical mixing of one ton of mixture. The following assumptions are made:

plant capacity 120 tons of mixture per hour;

minimum mixing temperature 140° C. and 1,000 kg batches;

additional amount of water (lower limit) of about 30 kg for each 1,000 kg batch;

about 60 kg of bitumen for each batch, one third of the heat content of the bitumen is used to maintain the temperature of the hot-delivered binder;

specific heat of the bitumen: $0.5\times4.19\times10^3$ Joule;

specific heat of the mineral content: $0.2\times4.19\times10^3$ Joule;

specific heat of the water: $1.0\times4.19\times10^3$ Joule;

water vaporization heat: $540\times4.19\times10^3$ Joule.

Without taking into account the efficiency of the unit, the following heat requirement Q results for a conventional plant under the foregoing assumptions.

| | | |
|---|---|---|
| 1. Heating the mineral substances, including the filler $(940 \times 0.2 \times 140)\ 4.19 \times 10^3$ | = | $110{,}280 \times 10^3$ Joule. |
| 2. Maintaining the binder temperature $(60 \times 0.5 \times 140)/3 \times 4.19 \times 10^3$ | = | $5{,}866 \times 10^3$ Joule. |
| 3. Heating with water $(140 \times 30)\ 4.19 \times 10^3$ | = | $17{,}598 \times 10^3$ Joule. |
| 4. Evaporating the water $(540 \times 30)\ 4.19 \times 10^3$ | = | $67{,}878 \times 10^3$ Joule. |
| Q (conventional) | | $201{,}622 \times 10^3$ Joule. |

This requirement corresponds to about 4.8 kg of extra-light heating oil/ton, which means an actual requirement of about 6 kg of heating oil/ton at an efficiency of 80%.

Moreover, the installed power of 310 KW, on the average, for a 120 ton unit, that is to say 310/120=2.58 KW/ton, is to be taken into consideration proportionately in establishing the energy consumption for prior art batch methods.

This heat requirement break-down which has been determined for a low mixing temperature and for a low water content, and the normal requirement of installed power for the compounding plant may increase drastically if the mixing is carried out under rather "wet" conditions. Nevertheless, this evaluation does not appear unrealistic, since the mineral substances, especially in the case of stationary plants, are taken, to an ever increasing extent, from supplies which are roofed over or covered, and are fed to the unit.

OBJECTS OF THE INVENTION

In view of the above, it is the aim of the invention to achieve the following objects singly or in combination:

to provide a process for mixing aggregate and binder components, especially for road construction which results in a reduction of the heat consumption while substantially reducing the installed power of the mixing plant;

to perform the mixing under such pressure and temperature operating conditions that an evaporation of any water enveloping the aggregate particles is avoided whereby such water will be distributed throughout the binder until removal at a later time especially during installation of the mixture;

to avoid the formation of dust prior and during the mixing so that dust removal equipment is obviated altogether; to increase the intensity of the mixing operation; and to provide a mixing apparatus for making bituminous mixtures under controlled pressure and temperature conditions.

SUMMARY OF THE INVENTION

The foregoing objects are achieved, according to the invention, by a procedure in which the aggregates, which are still largely moist, and the bituminous binder components are introduced into the mixing tank equipped with mixing tools and designed as a pressure tank. The mixing takes place in this tank under excess pressure established and maintained in the mixing tank, while also maintaining the mixing motion of the aggregates and heating the tank. The level of the excess pressure is adjusted so that it is equal to or above the level of the saturation pressure of the water adhering to the surfaces of the aggregates at the desired temperature of the mix being prepared, after adding the binder. If desired, the increased pressure in the mixing tank is reduced before emptying the mixing tank to a value below one bar whereby moisture is removed from the mixture.

The invention, by intentionally establishing a saturation pressure in the mixing tank, corresponding to the mixing temperature, avoids supplying any heat for the purpose of evaporating the water adhering to the aggregates. The intensive mixing establishes a system of water substantially distributed in the binder. Such system is a coarsely dispersed system at least under the prevailing pressure conditions. The system breaks up partially and loses its emulsion character and any possible foam-forming tendencies only after the emptying, and primarily during the installation and compacting phase.

It is known that bituminous mixtures have a good compactibility. The basic reasons why this is so, however, have not yet been completely researched, but the fact has been shown, for example, by the laying of mixture with an increased residual water content made by the process disclosed in the above mentioned German Pat. No. 1,594,815, even at laying temperatures below 100° C. in some instances. Thus, it would appear appropriate, in spite of the risk of a possible more rapid cooling by partial evaporation of water, to carry out the present process in a temperature range of up to about 140° C. as is conventional and to increase the temperature only as desired without substantially increasing the energy requirement.

Depending on the binder quality and/or in the case of an increased water content, it is also possible to admix an appropriate emulsifier additive to stabilize the binder water mixture which is then established in the mixer and may have an emulsion character.

Independently of this, however, the present process should in all cases be carried out in a temperature range between 130° and 160° C., with a water content of the mineral substances of 3% or less and without any additives.

Starting from a mixture temperature in the mixer of 140° C. and assuming an additional amount of 30 kg of water for each 1,000 kg batch, containing about 60 kg of bitumen, and assuming that one third of the heat content of the bitumen is used to maintain its delivery temperature and processing temperature, and without taking into consideration the efficiency of the unit, the heat requirement values given for the conventional process are corrected for the process according to the invention as follows:

| | | |
|---|---|---|
| 1. Heating of the mineral substances, including the filler $(940 \times 0.2 \times 140)\ 4.19 \times 10^3$ | = | $110{,}280 \times 10^3$ Joule |
| 2. Maintaining the binder temperature $(60 \times 0.5 \times 140)/3 \times 4.19 \times 10^3$ | = | $5{,}866 \times 10^3$ Joule |
| 3. Heating the water $(140 \times 30)\ 4.19 \times 10^3$ | = | $17{,}598 \times 10^3$ Joule |
| Q (according to the invention) | = | $133{,}744 \times 10^3$ Joule |

This corresponds to a reduction of the original heat requirement by about 34% to about 66%, or conversely, the conventional process calls for a heat consumption which is 1.5 times higher than that of the process according to the invention.

Since the formation of dust is not possible in the present process, the entire dust-removing unit with an installed power of about 120 KW and the drying drum with 40 KW are eliminated.

A pressurizer, that is to say, preferably, a compressor, with a power requirement of about 10 to 12 KW and a burner unit of 5 to 8 KW for a heating gas producer, are required for the present process.

140 KW can thus be deducted from the total power of 310 KW installed, so that the installed power per ton for a 120 ton unit operating in accordance with the present process, may be reduced to a value of 170/120, that is to a value of 1.42 KW per ton of mixture.

The process according to the invention thus achieves entirely the stated objective of reduced energy consumption.

Various possibilities may be chosen for supplying heat to the mixing tank as will be described in more detail below.

An apparatus according to the invention for performing the present process comprises a mixing tank or drum which is cylindrical or has any other shape of rotational symmetry and is rotatably mounted on a fixed axle, forming a hollow body, on a long-necked bearing. The hollow axle or body comprises connections for the supply and removal of the heating gas or hot gases.

The respective connections open into the mixing tank. The hollow body also carries the mixing tools in the tank. The supply line or conduit for the binder extends through the removal line. The supply and removal lines are arranged in such a manner that they form support axles extending perpendicularly to the central axle of the mixing tank, for tilting the tank and its drive on a support frame, from the filling position to the mixing position and from the latter position to the emptying position and back to the filling position. The charging hole is closeable by a pressure lid which is also located on the support frame and which may be lifted and tilted through an angle of about 90°.

It should be noted here that the intensity of the mixing process is increased by carrying out the mixing in a pressure range above the atmospheric pressure.

BRIEF FIGURE DESCRIPTION

In order that the invention may be clearly understood, it will now be described, by way of example, with reference to the accompanying drawings, wherein.

Figure 1:
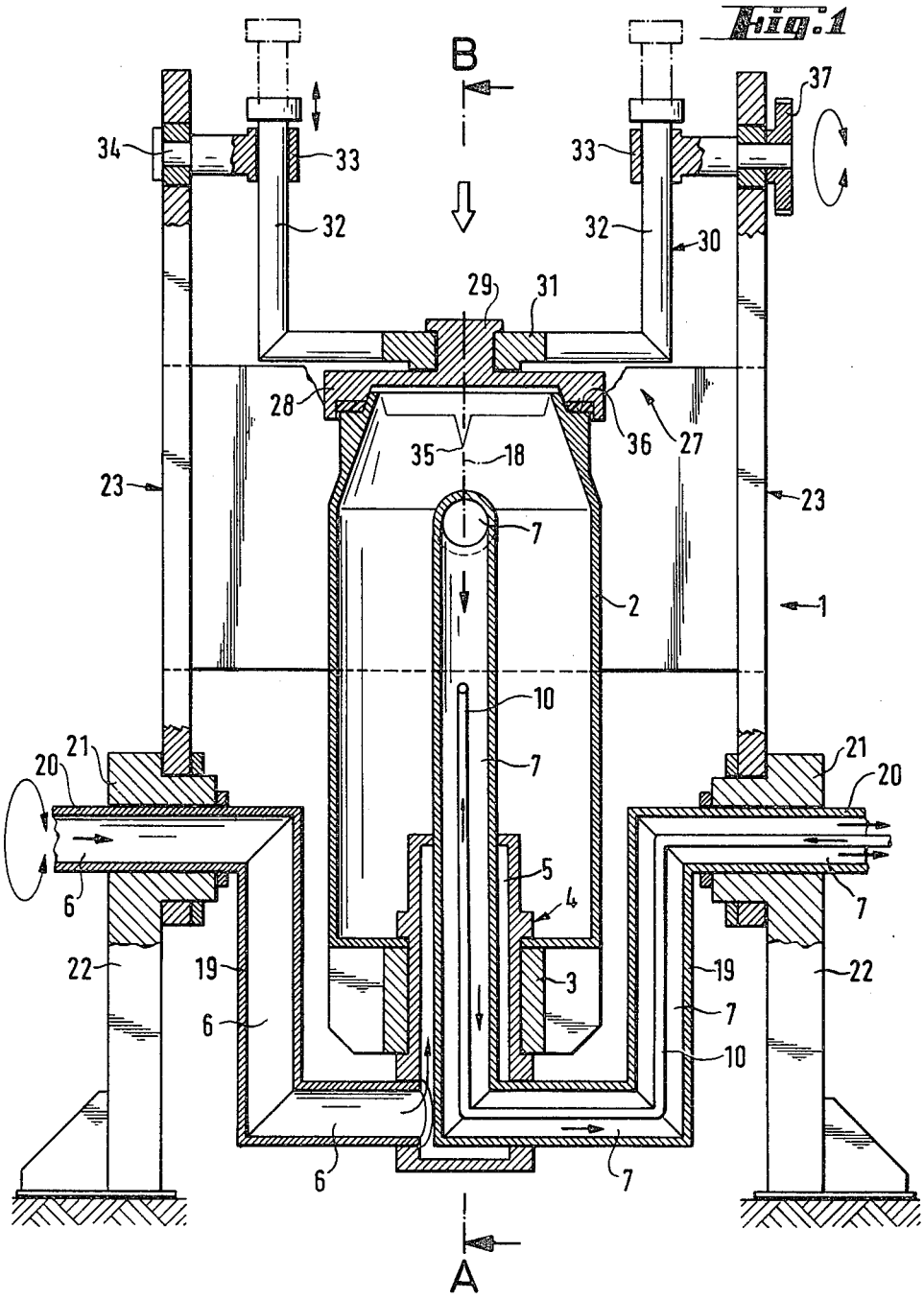
FIG. 1 shows a sectional view through a mixer according to the invention in the charging position, but with the pressure lid closure not yet open, whereby the section extends along line 1—1 in FIG. 2.

DETAILED DESCRIPTION OF PREFERRED EXAMPLE EMBODIMENTS AND OF THE BEST MODE OF THE PRESENT INVENTION

The mixing tank 2 is a component of a rotating drum mixer 1. The mixer rotates about a long-necked bearing 3 operatively secured to the mixer and mounted outside the mixing tank 2 proper. The axle 4 is stationary relative to the mixing tank 2. The axle 4 is essentially a cylindrical hollow body 5 through which the heating gas is supplied through a conduit 6. The heating gas is removed from the tank 2 through the hollow body 5 and a removal conduit 7. The heating gas feed conduit 6 ends directly in the hollow body 5 whereby the gas enters radially. The heating gas is passed through a branch conduit 8 into the heating gas distributor 9 which, according to FIG. 2 is located at the bottom of the mixer in the mixing position of the mixing tank 2.

Figure 2:
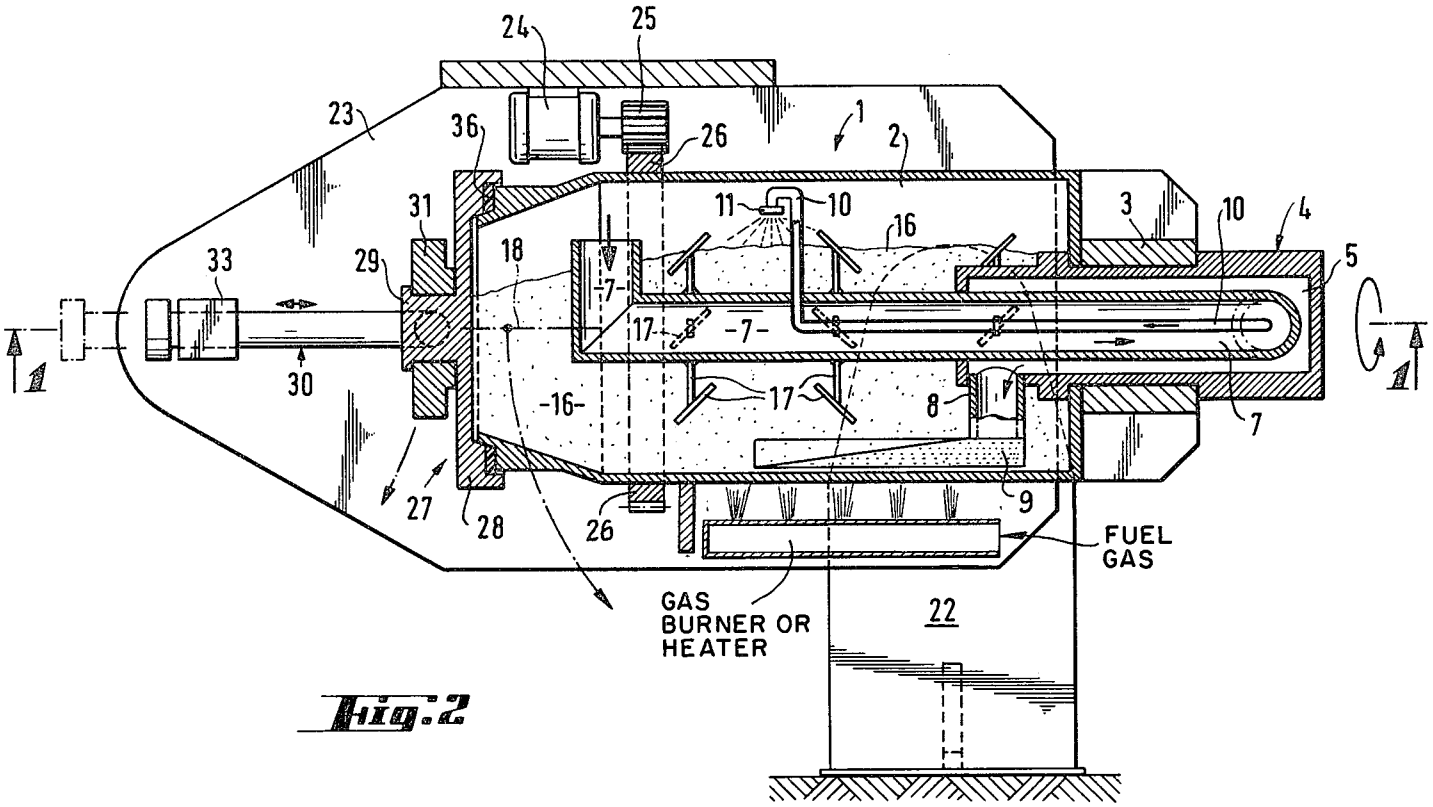
FIG. 2 shows a section through the mixer in its horizontal mixing position, along section line A–B shown in FIG. 1 with the mixing tank tilted through 90° as compared to the position of FIG. 1.

The heating gas removal from the tank 2 is effected, according to FIG. 2, when the tank 2 is in the mixing position by means of pipe elbow conduits 7 arranged to extend radially and centrally relative to the hollow body 5. The supply conduit 10 for the binder is located in the heating gas removal conduit 7. A binder metering nozzle 11 at the upper end of the conduit 10 opens into the upper free space of the tank 2 when the latter is in the mixing position, as shown in FIG. 2. The binder conduit 10 is led out of the heating gas removal conduit 7 at a suitable point as shown schematically in FIG. 3 and is connected through a movable member 12 to the binder metering means 13.

Figure 3:
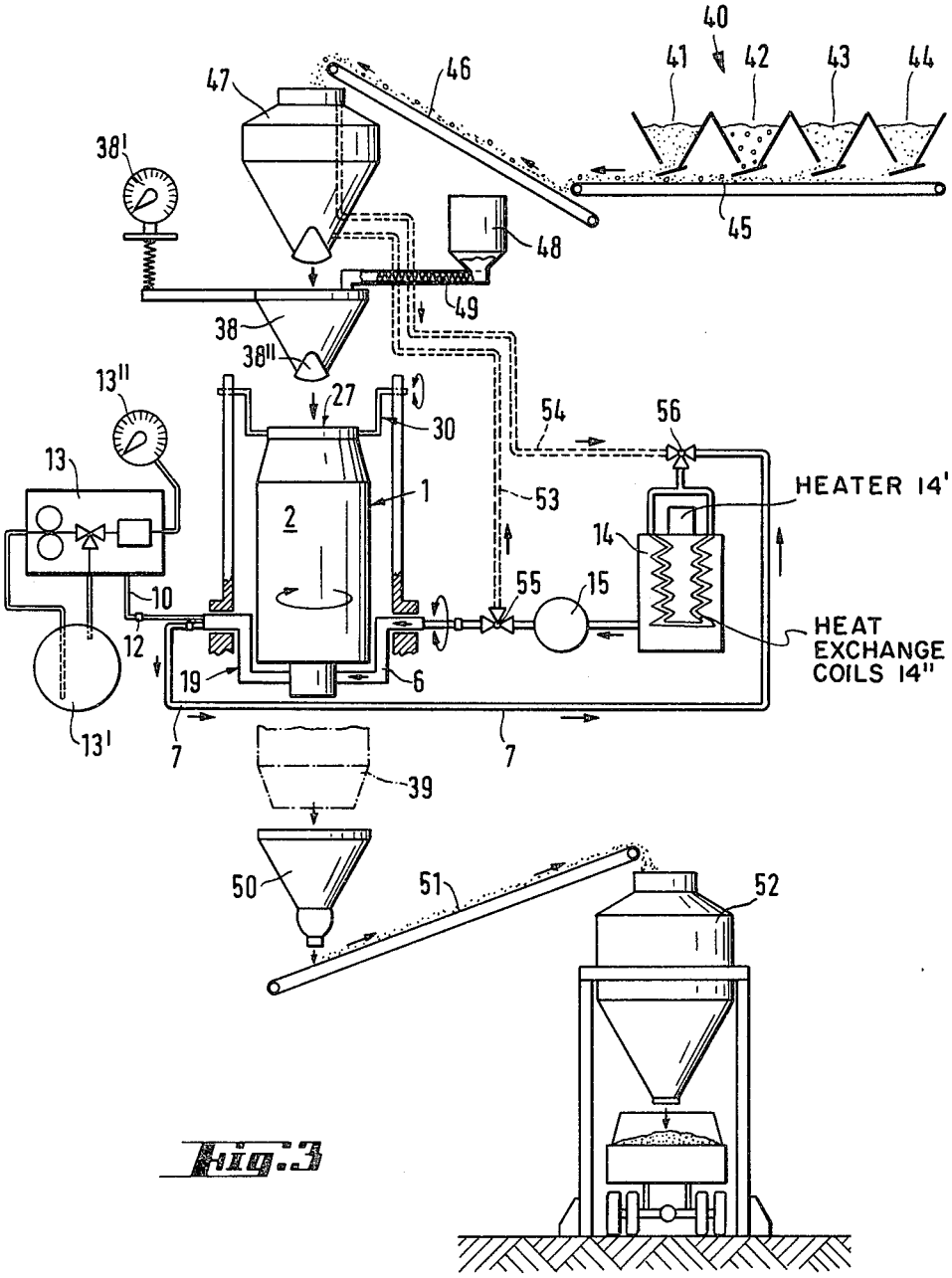
FIG. 3 shows the mixer as part of a plant for the preparation of bituminous mixtures.

As shown in FIG. 3, the heating gas is produced in the heating gas generator 14 and is conveyed through the compressor 15 connected with its intake or suction port from the generator 14 to the mixing chamber 2. The generator 14 cooperates with a heater 14' and includes heat exchange coils 14''. The heating gas supply and removal circuit thus runs through the heating gas feed conduit 6, the hollow body 5, the branch 8, the heating gas distributor 9 and the aggregate 16 deposited in the mixing tank 2 and is taken up by the heating gas removal conduit 7 and returned to the heating gas generator 14, whereby the mixing chamber or tank 2 is operatively connected to the heat exchange coils 14'' and the heater 14' supplies its heat to the coils 14''. The heater 14' may be supplied with a fuel gas.

With regard to the further construction of the mixer 1, it should also be noted that the heating gas removal pipe 7 arranged centrally in the mixing tank 2, is fitted with mixing tools 17. The heating gas feed pipe 6 and the gas removal pipe 7 extend first radially in a common plane and opposite each other relative to the axle 4 formed by the hollow body 5. The legs 19 of the pipes 6 and 7 extend at right angles to the radial portions of these pipes and at equal spacings from the rotational axis 18 of the axle 4 as well as in parallel to each other. Further, these two legs 19 extend approximately up to the center of gravity of the drum mixer and then branch off at right angles as best seen in FIG. 1. The pipe branches 20 form support axles for the drum mixer 2 which thus may be tilted through an angle of about 180°. The branches or support axles 20 are guided in bearings 21 mounted in the bearing pedestals 22. The support frame 23, which is tiltable with the mixing tank 2, carries the mixer drive means including a gear motor 24, a pinion 25 and gear ring 26. The frame 23 also carries the pressure lid closure 27 of the mixing tank 2 and the tilt-out means 34, 37. The support frame 23 itself is located on the cylindrical surface on a portion of the bearings 21 which is directed inwardly toward the mixer 1.

The mixing tank 2 is charged when it takes up a substantially vertical position after the pressure lid closure 27 has been opened. The lid is opened usually when the mixer is in the emptying position 39 shown by dash-dotted lines in FIG. 3. The charge is first supplied into a weighing container 38, in which the aggregates to be added are brought together in predetermined weight quantities according to the mixing recipe.

The pressure lid closure 27 comprises the lid 28 proper which reaches over the mixer opening 35 and rests against the sealing surface 36, which is protected against the material leaving the mixer by the rim of the opening 35. The pressure lid 28 is pressed against the seal 36 and rotates with the mixing tank 2. The pressure lid 28 extends into a journal pin 29, which in turn is received by the bearing 31 mounted in a U-shaped support fork 30. The legs 32 of the support fork 30 pass, on either side, into journals 34 which are provided with slide bearings 33 and are mounted in the support frame 23 such that they can be tilted. Due to the slide bearings 33 the support fork may be raised and lowered, together with the connected pressure lid 28, by means not shown, such as pressure cylinders or servomotors. In order to be able to move the pressure lid 28 out of the flow of material during filling and emptying, it is lifted and then tilted through an angle of about 90°. The tilting is accomplished by the drive 37 connected to the journals 34. The repeated, timely operation of the lid is incorporated in the overall control of the mixing plant provided for carrying out the process. The tilting of the drum mixer 1 into the mixing position or its transfer to the emptying position 39 is also subject to the overall control of the plant. Such control is not part of this invention.

A mixing plant for properly performing the present method is shown in FIG. 3. The aggregates are introduced from a supply, into the individual metering cells 41 to 44 of a metering apparatus 40, for example, by means of front end loaders. These dosing cells 41 to 44 supply the aggregates in proportions according to the recipe, onto the collecting conveyor belt 45 which transports the aggregates to a reservoir 47, either directly or by other means of conveyance, for example, the conveyor belt 46. In this reservoir 47, if desired, it is possible to pre-heat the material by means of excess heating gases or exhaust gases or the like and/or to partially remove moisture from the aggregate by suitable measures, for example by vibration.

The aggregates are transferred batchwise from the reservoir 47 into the weighing container 38 when the weighing dial 38' is in the zero position and when the raidl type filling valve 38'' is closed. The amount of filler additionally required is weighed in, from a filler bin 48 by a metering screw 49. The water content of the aggregates may also be determined, for example, capacitively, in the reservoir 47, and the control value may be readjusted continuously on the weighing dial 38' according to the result of the determination.

When the weighing of a batch has been completed, the radial type filling valve 38'' of the weigher 38 remains locked for a further period, until the opening 35 of the mixing tank 2 has been tilted to a fixed position under the weighing container 38, with the lid 28 open. The radial type filling valve 38'' of the weighing container 38 now unlocks and opens whereby the contents of the weighing container 38 empty into the mixing tank 2. Return of the weighing dial 38' to the zero position supplies a pulse for initiating a repetition of the weighing and at the same time a pulse for closing the pressure lid 28. When these steps have been completed, the mixing tank 2 is tilted back into the mixing position according to FIG. 2.

In this position, an excess pressure which is greater than the saturation pressure of the surface water of the aggregates, at the desired mixing temperature in the mixing tank, is established by compressed heating gases or hot air in the mixing tank 2, which rotates continuously during all the operating phases. The bituminous binder is added when the tank 2 is in the mixing position and mixed intimately with the aggregates during this mixing period. The residual water, together with the binder, forms a partial emulsion which uniformly coats the individual solids.

To further illustrate the operation, it is suggested that the heating gases produced in the heating gas generator 14 are drawn in by a pressurizer, preferably by a compressor 15, and are passed, as described, through aggregates 16 in the mixing tank 2.

The cooled gases are returned from the mixing tank 2 through the heating gas removal pipe 7 into the heating gas generator 14, by a means not shown, whereby the prescribed pressure is maintained in the tank 2.

The required amount of binder is drawn from the binder reservoir 13' through the binder metering device 13 according to the setting on the presettable metering device 13'' and is passed to the aggregates 16 through the nozzle 11.

When the required mixing temperature is reached in the mixing tank 2, which temperature may, if desired, be identified by a presettable control time, the heating gas supply, for example, to an external gas burner or heater shown in FIG. 2, is switched off after the injection of the binder has been completed, whereupon the mixing tank 2 tilts downwardly through an angle of about 90° into the emptying position 39, shown in dash-dotted lines 39, FIG. 3. Opening of the lid 28 starts with locking of the mixing tank 2 in the emptying position as explained above.

The mixing tank 2 empties into a collecting tank 50 and onto a conveyor belt 51 leading to a loading tank 52 for the mixture.

At the end of a preset period sufficient for emptying, the mixing tank 2 tilts to a position below the weighing container 38 to bring its opening 35 into the charging position. The lid 28 remains open during this tilting operation through about 180°.

In order to enable the heating gas to be produced continuously a procedure may be provided in which, during the charging and emptying phases of the mixing tank 2, the produced heating gases are passed through the reservoir 47 through piplines 53 and 54, shown as dotted lines, provided with reversal control means such as valves 55 and 56. However, this procedure must be monitored and controlled thermostatically, since the invention teaches that no evaporation work, at least no significant evaporation work, should be effected in the reservoir 47, but only heat should be supplied to the material.

Incidentally, the present invention is capable of providing, for example 120 tons per hour if one assumes, and such assumption in practical, that each batch has a weight of one ton. For 120 batches per hour, the mixing time for each batch is about 20 seconds and the filling and emptying times each require about five seconds.

Incidentally, the compression of the heating gases or heated gases supplied into the mixing tank 2 is such as to assure at least the saturation pressure of the water adhering to the aggregates or to a higher pressure, and these gases are passed, essentially in a closed circulation during the mixing through the material to be mixed and the heating gas or hot gas generator. Such pressure is maintained during the mixing process.

Another possibility for heating the mixture is to supply heat to the mixing tank 2 by means of a heat exchanger, located in the mixing tank, through which the heating gases or hot gases or other heat transfer media flow.

The above mentioned use of the heating gas during the filling time and emptying time of the mixing tank, for supplying heat to the reservoir 47 through the pipes 53, 54 merely preheats the aggregate without any substantial drying.

Thus, an uninterrupted operation of the heating gas generator or of the heater for the heat transfer medium is made possible by the repeated switch-over controlled by the valves 55, 56. The residence time of the material in the mixer can be reduced by such a preheating or also by any other preheating which is not associated with true evaporation work.

Independently of the above mentioned possibilities for heating the aggregates in the mixing tank, heat may be supplied to the mixing tank by any desired external heating of the tank.

Although the invention has been described with reference to specific example embodiments, it will be appreciated, that it is intended to cover all modifications and equivalents within the scope of the appended claims.

What is claimed is:

1. A method for preparing a mixture of aggregate and a bituminous binder component, comprising the following steps: supplying a batch of moist aggregate into a pressurizable mixing container, supplying a respective quantity of the bituminous binder component into said pressurizable mixing container, starting a mixing motion of the aggregate and the bituminous binder component in the mixing container, closing the mixing container, heating the content of the mixing container to a mixture temperature and increasing the pressure in the mixing container to a value corresponding at least to the saturation pressure of the water adhering to said moist aggregate at said mixture temperature, maintaining the mixing motion and the mixture temperature at said increased pressure until the mixing is complete, and then discharging the mixture while depressurizing the mixing container.

2. The method of claim 1, wherein said mixture temperature is within the range of 130° C. to 160° C., and wherein said increased pressure is above said saturation pressure within the range of 2,5 bar to 7 bar.

3. The method of claim 1, comprising the further step of reducing the pressure inside the mixing container prior to discharging a mixed batch, to a pressure below one bar whereby moisture is removed from the mixed batch.

4. The method of claim 1, wherein said heating of the content of the mixing container comprises pressurizing a heating gas to a pressure corresponding at least to said saturation pressure of said water adhering to said moist aggregate and supplying said pressurized heating gas into the mixing chamber.

5. The method of claim 4, wherein said pressurized heating gas is a fuel gas supplied for combustion into said mixing chamber for heating the mixture.

6. The method of claim 4, wherein said pressurized gas is heated prior to being supplied into said mixing chamber for heating the mixture.

7. The method of claim 1, wherein said heating of the content of the mixing container comprises operatively connecting heat exchanger means to said mixing chamber and supplying a heating medium to said heat exchanger means.

8. The method of claim 7, wherein said heating medium is a fuel gas supplied for combustion into said heat exchanger means.

9. The method of claim 7, wherein said heating medium is a gas heated prior to being supplied to said heat exchanger means.

10. The method of claim 1, further comprising supplying the heat, which during the mixing is used for said heating of the content of the mixing container, to an aggregate supply container during times when the mixing container is being emptied and filled again.

11. The method of claim 1, wherein said heating of the content of said mixing container is accomplished by externally heating the mixing container.

12. The method of claim 1, further comprising adding an emulsifier to the bituminous binder component, said emulsifier being present in the amount of 1% by weight to 4% by weight of the weight of the bituminous binder component.

13. The method of claim 12, wherein said emulsifier is soap.

14. An apparatus for mixing aggregate and a bituminous binder component, comprising mixing drum means (2) including bearing means (3), stationary, hollow body means (4) operatively cooperating with said bearing means (3) for rotatably supporting said drum means (2), said hollow body means comprising inlet means (6) for supplying gas into said mixing drum means (2) through said hollow body means and outlet means (7) for removing gas from said mixing drum means (2) also through said hollow body means (4), binder component supply means (10) extending through said hollow body means (4) into said mixing drum means (2), mixing tool means (17) operatively supported inside said mixing drum means, frame means (22), tilting axle means (20) operatively supporting said mixing drum means on said frame means for tilting the mixing drum means into several different positions, a filling and discharge opening in said mixing drum means, pressure tight cover means, and cover carrier means operatively supported and holding said pressure tight cover means for moving the latter into a drum closing position and into a drum opening position.

15. The apparatus of claim 14, wherein said inlet means (6) and said outlet means (7) each comprise pipe means arranged for cooperation with said hollow body means, said pipe means comprising sections (19) extending substantially in parallel to said mixing drum means and further sections (20) extending substantially perpendicularly to said mixing drum means, said further pipe sections (20) constituting said tilting axle means for said mixing drum means.

16. The apparatus of claim 14, wherein said pressure tight cover means are supported by said frame means for tilting the pressure tight cover means through an angle of about 90°.

17. The apparatus of claim 14, wherein said mixing drum means are tiltable from a filling position into a mixing position and from the latter into a discharge position and from the latter back into the filling position.

18. The apparatus of claim 14, wherein said gas inlet means comprise pipe means leading into said hollow body means, said hollow body means comprising openings for introducing gas into said mixing drum means, said gas outlet means comprising further pipe means extending substantially longitudinally and coaxially through said hollow body means, said supply means for said bituminous binder component extending substantially coaxially through said further pipe means into said mixing drum means.

19. The apparatus of claim 18, wherein said further pipe means comprise a pipe portion extending out of said hollow body means and into said mixing drum means, said mixing tool means being secured to said pipe portion.

20. The apparatus of claim 14, wherein said pressure tight cover means comprise bearing means (29, 31) which permit the supporting of the pressure tight cover means in the drum closing position and when the drum is rotating.

* * * * *